United States Patent [19]

Lewis

[11] Patent Number: 4,563,842

[45] Date of Patent: Jan. 14, 1986

[54] POLE-TYPE STRUCTURE AND METHOD OF CONSTRUCTING SAME

[76] Inventor: Bradley D. Lewis, 3682 Shelbourne Ct., Carmel, Ind. 46032

[21] Appl. No.: 555,073

[22] Filed: Nov. 25, 1983

Related U.S. Application Data

[63] Continuation of Ser. No. 320,074, Nov. 10, 1981, abandoned.

[51] Int. Cl.[4] ..... E02D 27/00

[52] U.S. Cl. ..... 52/169.9; 52/169.5; 52/742; 52/236.6; 52/169.11

[58] Field of Search ..... 52/169.1, 169.5, 169.9, 52/169.11, 742, 90, 93, 274, 210, 272, 236.3, 236.6, 283, 293, 299, 167

[56] References Cited

U.S. PATENT DOCUMENTS

| | | | |
|---|---|---|---|
| 404,612 | 6/1889 | Evans | 52/90 |
| 991,751 | 5/1911 | Salfield . | |
| 1,529,516 | 3/1925 | Thorne | 52/299 X |
| 1,857,926 | 5/1932 | Mason et al. | 52/169.1 |
| 2,260,105 | 10/1941 | Hasenburger et al. . | |
| 2,280,687 | 4/1942 | Connelly | 52/293 X |
| 2,308,248 | 1/1943 | Rehn . | |
| 2,438,604 | 3/1948 | Gogerty | 52/299 |
| 2,618,146 | 11/1952 | Ciarlini | 52/236.6 X |
| 2,702,413 | 2/1955 | Kamisato . | |
| 2,743,602 | 5/1956 | Dunn | 52/169.9 |
| 3,082,576 | 3/1963 | Bailey | 52/93 X |
| 3,146,864 | 9/1964 | Nystrom et al. | 52/93 |
| 3,216,163 | 11/1965 | Carew | 52/169.9 X |
| 3,349,527 | 10/1967 | Bruns | 52/169.9 |
| 3,462,897 | 8/1969 | Weinrott | 52/90 X |
| 3,557,502 | 1/1971 | Krebs | 52/169.1 |
| 3,771,273 | 11/1973 | Brodie | 52/169.9 X |
| 3,921,356 | 11/1975 | Hughes | 52/299 |
| 4,065,895 | 1/1978 | Shank et al. | 52/210 |
| 4,221,090 | 9/1980 | Pahl | 52/169.9 |
| 4,229,919 | 10/1980 | Hughes | 52/263 |
| 4,320,604 | 3/1982 | O'Hanlon | 52/169.11 X |
| 4,472,916 | 9/1984 | Krebs | 52/169.1 |

OTHER PUBLICATIONS

Low-Cost Pole Building Construction, by Doug Merrkees & Evelyn Loveday, Garden Way Publ., Jul. 1979, pp. 8-22.

*Primary Examiner*—Alfred C. Perham
*Assistant Examiner*—Jean M. LaKemper
*Attorney, Agent, or Firm*—Woodard, Weikart, Emhardt & Naughton

[57] ABSTRACT

A pole-type structure having a plurality of outer walls arranged together so as to define an interior region includes a series of holes excavated below the existing grade line into which a concrete bearing pad is poured. After the concrete sets, a pole is placed in the hole and onto the concrete bearing pad. The resultant plurality of poles provides the main structural support members for the structure. Secured to the poles are bearing plates which extend from pole to pole in a perpendicular arrangement, and disposed across the top of these bearing plates is a spaced plurality of floor joists. The floor joists extend toward the exterior of the structure beyond the poles and the outwardly extended end portion of each floor joist provides a support portion for the exterior surface of the structure, which is brick veneer. The various poles which are placed in the holes and supported by the concrete bearing pads provide the support for the roof portion of the structure, thus permitting the interior wall portion to become a nonload-bearing wall.

10 Claims, 7 Drawing Figures

POLE-TYPE STRUCTURE AND METHOD OF CONSTRUCTING SAME

This is a continuation of Ser. No. 320,074 filed Nov. 10, 1981, now abandoned.

BACKGROUND OF THE INVENTION

The construction of structures wherein the load-bearing members are poles is often referred to as pole construction. While such a construction concept has been employed for several years, particularly in the construction of barns (i.e., pole barns), it is becoming a more popular construction technique for home construction due to the fact that the technique is inexpensive and relatively simple when compared to more conventional construction techniques.

Pole construction uses poles or timbers which may be either circular, rectangular or square and which are embedded and anchored into the ground. Support within the ground is provided by bearing pads, typically concrete, into which the pole is set. Thereafter, each hole is filled with a particulate medium such as gravel. The only excavation required for the structure is that for the bearing pads and poles. The poles provide not only the foundation for the structure, but also portions of the bracing and framework for the walls. Floor joists, walls and the roof are thereafter able to be secured to the poles for completion of the structure.

The ability to use longer pieces of lumber permits the structure to be completed more rapidly, and shorter construction time can be a great advantage in instances when bad weather is a consideration. Other advantages of pole construction include the elimination of scaffolding, reduction in the amount of sawing, minimum labor requirements, both the amount and skill level, the ability to use less lumber, the need for only simple hand tools, and high resistance to wind forces. While the pole-type construction technique which has just been described may be considered as somewhat "typical," there are a number of variations on this main theme. Some of these variations are disclosed by the following listed patents, each of which is discussed hereinafter.

| Patent No. | Patentee | Issue Date |
|---|---|---|
| 2,618,146 | Ciarlini | 11/18/52 |
| 3,921,356 | Hughes | 11/25/75 |
| 4,229,919 | Hughes | 10/28/80 |
| 2,260,105 | Hasenburger et al. | 10/21/41 |
| 4,065,895 | Shank et al. | 1/03/78 |
| 3,216,163 | Carew | 11/09/65 |
| 2,438,604 | Gogerty | 3/30/48 |
| 2,308,248 | Rehn | 1/12/43 |
| 2,702,413 | Kamisato | 2/22/55 |
| 991,751 | Salfield | 5/09/11 |

Ciarlini discloses a reinforced concrete column including a bracket and beam joint. The invention pertains generally to building construction wherein prefabricated and reinforced concrete elements are used, and of possibly some interest to the present invention is the disclosure of concrete piers which are disposed beneath the ground level for the support of hollow cement columns. These columns extend through brackets which in turn support and attach to main beams. There is no disclosure in this particular reference of utilizing either the brackets or the main beams for the support of an exterior wall.

Hughes ('356) discloses a system and method for erecting a structure elevated off the ground wherein post holes of approximately eight inches in diameter receive a pipe which is rigidly fixed in place by cement that is poured into the holes. A typical type of structure disclosed for this construction technique is a park bench. There is no disclosure that this method may be used to construct a home or residence nor is there any disclosure of using any portion of the frame to support an exterior wall.

Hughes ('919) is a continuation of the prior Hughes patent and thus, the disclosed concepts are the same.

Hasenburger et al. discloses a frame construction technique for buildings which has as an objective the ability to provide improved means for quickly and securely joining in rigid assembled relation the spaced vertical studs, floor joists, roof rafters and other similar frame members of a building. This object is presumably attained by the employment of mechanical fastening means which enable such connections to be quickly and inexpensively accomplished without marring or destroying the frame-forming members. Thus, the members may be dismembered without injury and in a completely intact condition for further service. This particular reference is believed to be of only limited relevancy with respect to the present invention.

Shank et al. discloses a wood building construction technique which includes a panelized wall and/or floor which does not require any masonry foundation. While this particular reference may be of general interest for the various ways of joining wood structural members together, its lack of any masonry foundation requires that the floor construction be placed directly on a gravel bed. The result is that the walls become load-bearing members. This reference is also felt to be of only limited relevancy to the present invention.

Carew discloses an integrated building framing and floor arrangement wherein a conventional I-beam is secured to a concrete footer and a leveling plate provides a support surface to which elongated wall panels may be secured. The entire construction concept which is disclosed relates primarily to steel I-beam and concrete construction and would not appear appropriate for residential construction. Additionally, the massive size and weight of the various construction members suggest a very time-consuming and expensive construction procedure thus deviating drastically from the desired objectives of pole-type construction.

Gogerty discloses a prefabricated and demountable house construction wherein homes are able to be prefabricated at a central point and then rapidly erected on the home site in order to provide both a sturdy building, yet a building that is capable of being dismantled and reerected at some other location. While concrete piers are used for the foundation, these are placed against the surface of the ground in order to provide an air space between the underside of the building and the top surface of the ground. Consequently, this particular construction technique does not employ the use of poles as the load-carrying members nor are the poles anchored into the ground so as to provide a secure and sturdy foundation. Additionally, the floor joists and supports do not extend beyond the poles so as to provide a rigid and strong support portion for an exterior wall, such as brick veneer. The ability of providing an exterior wall of a conventional nature permits the construction of a home which is conventional in virtually all regards, both as to structure as well as appearance. The one exception is that the home is constructed with pole-type construction techniques being employed so as to allow the home to be constructed quicker and in a less-expensive manner.

Rehn discloses a building construction technique which is particularly adapted to small cabins, roadside inns and similar structures. The construction technique employs a plurality of prefabricated wall units which are secured to a floor portion that is set upon a foundation. The floor portion of the structure is not utilized in any way to support the exterior, but rather the prefabricated wall portions which secure to the floor also rest upon the foundation thus making all of the walls load-bearing members for the remainder of the structure.

Kamisato discloses a prefabricated wall construction technique wherein a variety of wooden members are secured to one another in an attempt to make the prefabricated structure that results applicable to tropic environments. One characteristic of the construction technique that makes the resultant structure suitable for tropic environments is that the barest minimum of materials are used and the entire structure is supported by posts which are spaced at intervals and driven or otherwise secured in the ground. However, the outer wall also constitutes the inner wall and this wall portion is secured directly to the posts and in that regard becomes a load-bearing member for the entire structure.

Salfield discloses a building construction technique wherein vertical wooden members are secured to a sole plate which is thereafter attached or secured to a concrete or cement footing. The vertical wooden members are used to provide both support for the floor as well as the exterior surface of the structure. This particular reference is believed to be of only limited relevancy with respect to the present invention.

The more general nature of pole construction is disclosed by the book *Low-Cost Pole Building Construction* by Doug Merrilees and Evelyn Loveday, published by Garden Way Publishing, 9th printing, July 1979. Pages 8–22 offer a good general discussion of pole construction.

Of particular note as to all of the listed references and the publication, is that none disclose concepts or means to extend the floor joist outwardly beyond the poles so that these joists in combination with support plates and related structural members are able to support a conventional brick exterior. Consequently, it would be an improvement to these earlier concepts and structures to provide that capability so that the pole building construction may be used for more conventional housing, both as to structural details as well as exterior appearance.

SUMMARY OF THE INVENTION

One embodiment of the present invention includes a pole-type structure having a plurality of walls arranged to define an interior region, wherein at least one wall includes a plurality of poles spaced apart from each other, means for supporting the plurality of poles in the earth beneath the structure, a plurality of floor joists connected to the plurality of poles, each of the plurality of floor joists having a support portion adjacent one end, the support portion extending exteriorly of the poles and an exterior wall veneer disposed exteriorly of the poles and supported by the support portions of the plurality of floor joists.

One object of the present invention is to provide an improved pole-type structure.

Another object of the present invention is to provide an improved method of constructing a pole-type structure.

Related objects and advantages of the present invention will be apparent from the followiing description.

DESCRIPTION OF THE PREFERRED EMBODIMENT

Figure 1:
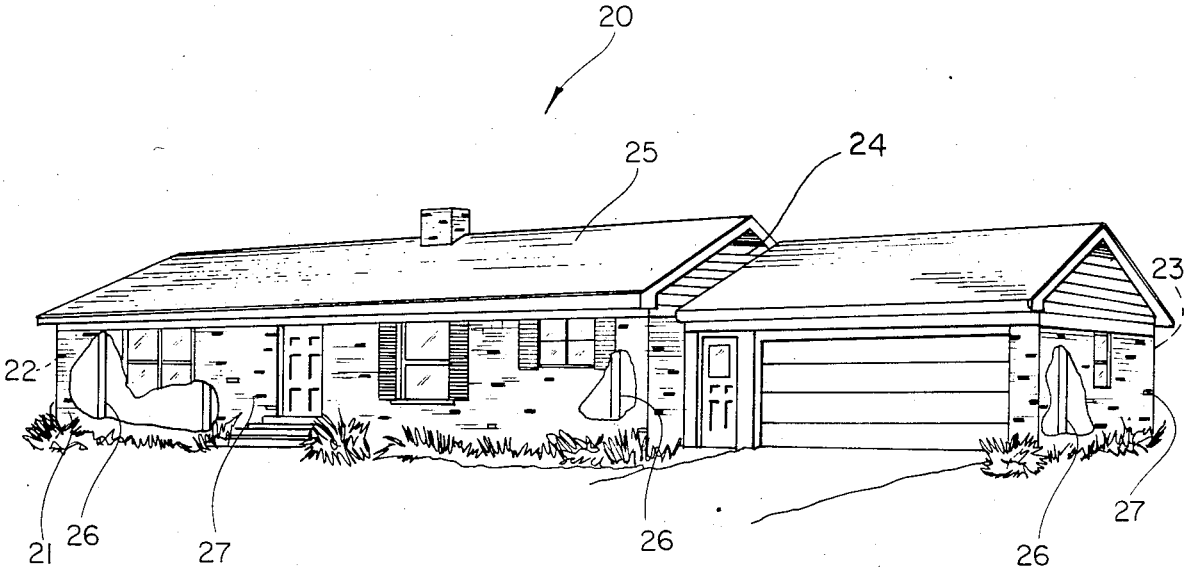
FIG. 1 is a fragmentary perspective view of a pole-type structure according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a pole-type structure 20 which includes four walls 21, 22, 23 and 24, a roof 25 and a series of poles 26 which are disposed interior to brick veneer 27. Each wall is arranged into an exterior wall portion (brick veneer 27) and an interior wall portion, which is drywall in the exemplary embodiment. Although the design of this structure may vary as to its specific exterior appearance, the use of poles as the main structural members remains consistent throughout. As will be explained hereinafter and as is illustrated in FIGS. 2–7, poles 26 are disposed between the interior wall surfaces of the structure and the exterior brick veneer 27. This arrangement permits the poles to provide the various advantages of pole-type construction without the poles being visible from either the inside or outside of the structure. The four walls 21–24 are arranged in an enclosing manner so as to define an interior region or living space. This interior region or living space is then enclosed and covered by roof 25.

Figure 2:
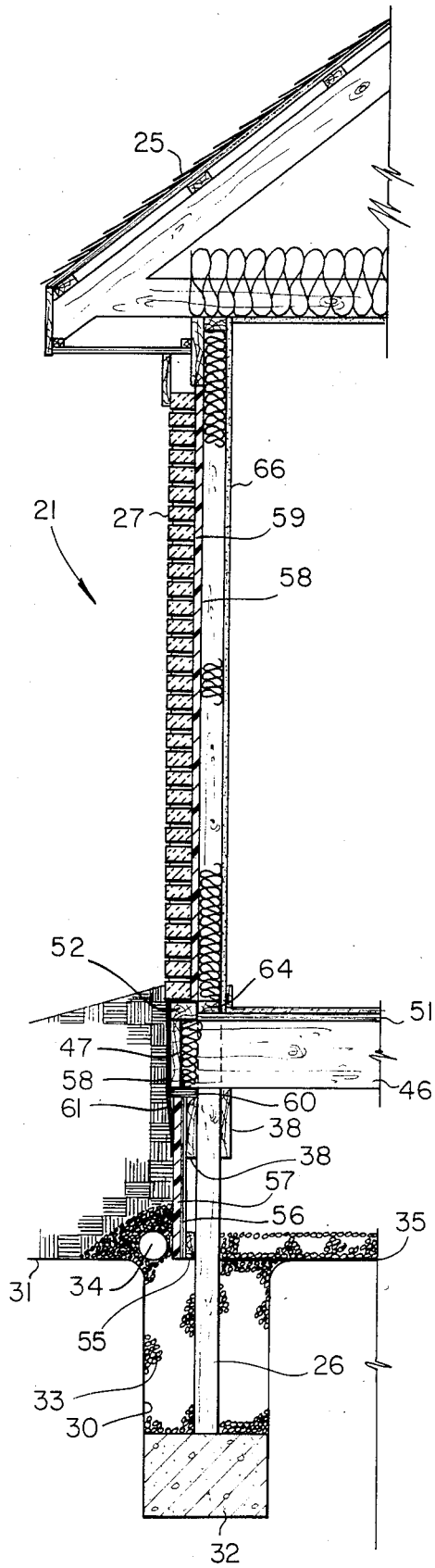
FIG. 2 is a side elevation view in full section of a wall portion of the FIG. 1 structure.
Figure 3:
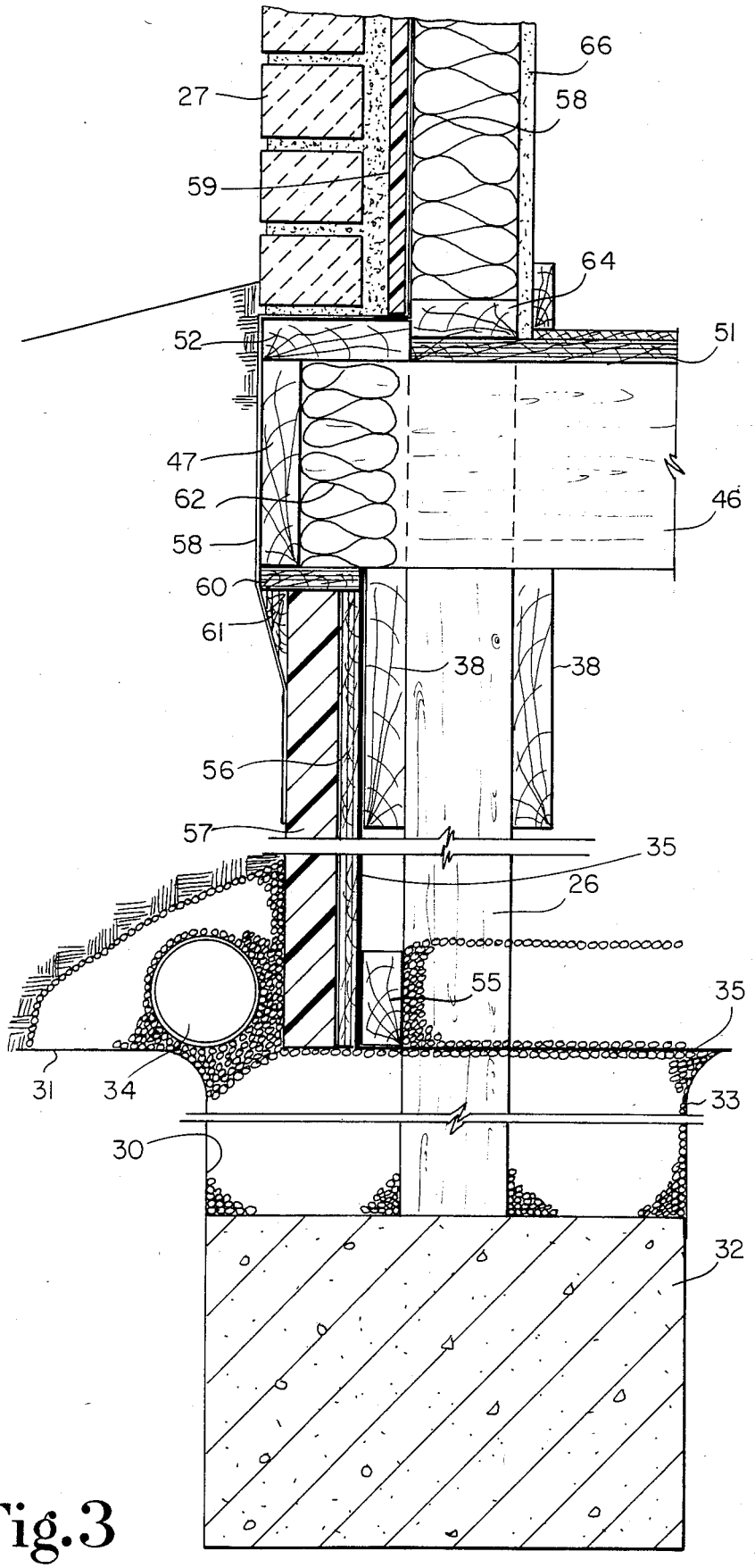
FIG. 3 is a partial, enlarged detail view in full section of the FIG. 2 wall portion.

Referring to FIG. 2, wall 21 is illustrated in greater detail and is represented in full section in order to provide an understanding of the construction concepts employed. Since wall 21 has been selected as a representative wall, any doors and/or windows which might otherwise be present have been omitted from the illustrated view in order to focus solely on the construction concepts and techniques, and it should be understood that walls 22, 23 and 24 are constructed in a similar manner to wall 21.

The pole-type construction method of the present invention begins with the excavation of holes 30 below the existing grade line 31. Although a side elevation view is provided, and only one hole, it should be understood that one hole 30 is required for each pole 26 and that the location of the holes coincides with the centerline-to-centerline spacing of the poles. This particular centerline spacing in the exemplary embodiment is every eight feet. Related spacing increments of 2-foot multiples are also acceptable, such as 10 feet or 12 feet, as will be explained hereinafter. The specific distance selected for this centerline spacing may be governed in part by the particular architectural style selected for the structure.

Each hole 30 is approximately 3 feet deep and 18 inches in diameter. Poured into each hole is a concrete bearing pad 32 which is approximately 12 inches deep and onto which one pole 26 is placed and centered. It is important that each pole be located somewhat precisely at the center of each hole and that each pole extend upwardly with an orientation that is perpendicular to the top surface of the bearing pad. The remaining cavity of each hole 30 is then filled with gravel 33 and gravel is added above the grade line to the outside or exterior of the poles and is arranged so as to enclose perforated perimeter drain 34. A vapor barrier 35 is laid down across the existing grade line, across holes 30, and around the poles, toward the exterior, to a location beyond the poles. The vapor barrier is covered in part with a thickness of pea gravel which is walled in by purlin members. The poles 26 which are 4 by 4's extend upwardly for several feet to the location of the roof, and these poles provide the support for the entire structure. This construction technique permits the interior walls of the structure to be nonload-bearing members.

Figure 4:
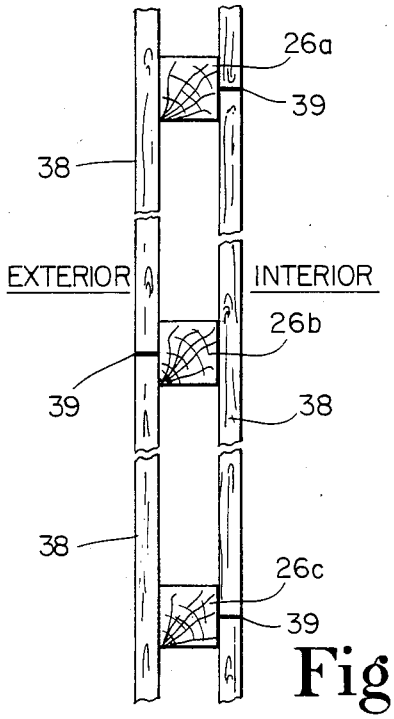
FIG. 4 is a top plan schematic view of bearing plates as assembled to the poles of one wall of the FIG. 1 structure.

Support of the floor and interior walls is provided in part by wooden bearing plates 38 which extend across the series of poles for each wall and ideally, the length of these plates is a single or multiple of the spacing between poles so that the abutting joint between adjacent plates is coincident with the centerline of a pole. Additionally, since one series of plates is exterior and the opposite series of plates is interior of the poles, the abutting joints may be staggered between the interior and exterior series of bearing plates. FIG. 4 is a top plan view of such a staggered arrangement. Poles 26*a*, 26*b* and 26*c* are located on 8-foot centers and plates 38 are each 16 feet long. While an 8-foot length for one or more of the bearing plates may be required at the ends or corners of the particular wall, the mid-wall area which is illustrated schematicaly by FIG. 4 shows that the abutting joints 39 are staggered from interior side to exterior side with each successive pole.

Figure 5:
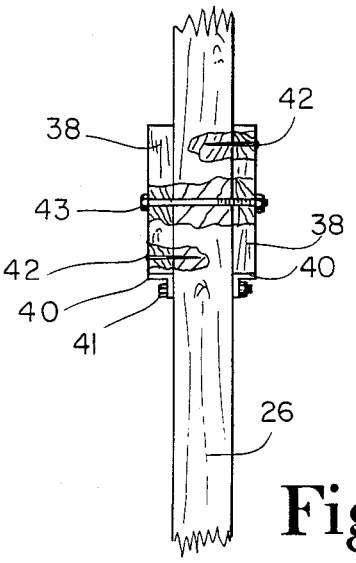
FIG. 5 is a partial, fragmentary side elevation view of the FIG. 4 bearing plates as assembled to the poles of one wall.

Each bearing plate extends in a horizontal direction and its longitudinal axis or centerline is substantially perpendicular to the longitudinal axes of the poles which extend in a vertical direction. The bearing plates are secured to each pole, regardless of whether or not an abutting joint is present at the pole. The means of securing is illustrated in FIG. 5 and includes steel L-brackets 40 which are disposed beneath each bearing plate and are bolted through the corresponding pole 26 by means of bolt 41. Initially, the bearing plates are secured to the poles by nails 42 and then by bolts 43 which extend completely through both plates and the corresponding pole. A plurality of bolts 43 are used, although only one is illustrated. Each bearing plate is a 2 by 10 wooden member and is turned so that the long edge dimension extends in the vertical direction.

Figure 6:
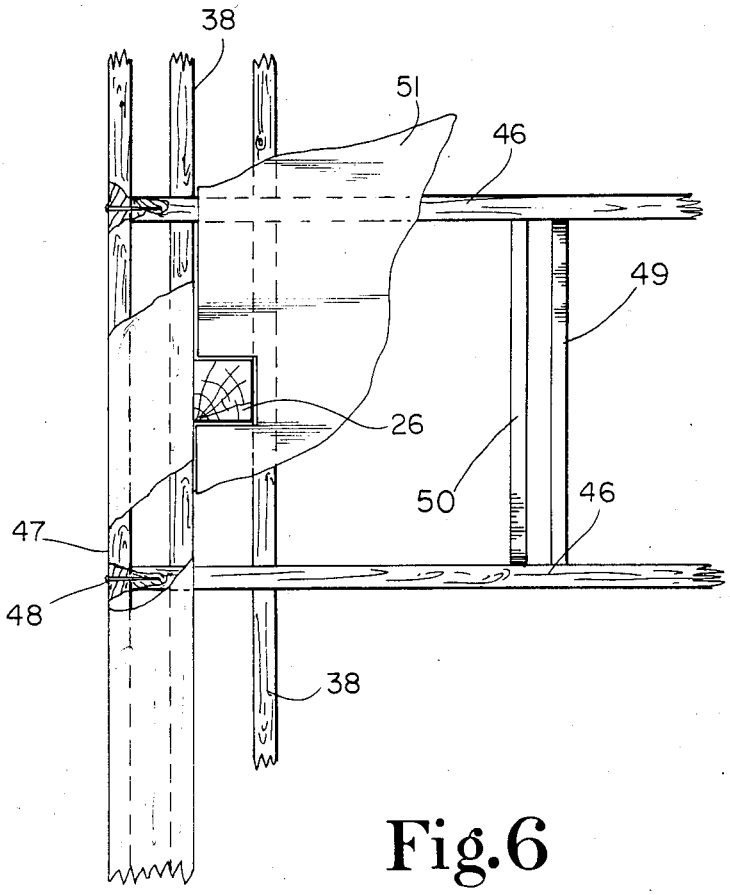
FIG. 6 is a top plan schematic view of the floor joists as assembled to other structural members of the FIG. 1 structure.

Referring to FIG. 6, the assembly of the floor joists 46 into the structure is illustrated, and each floor joist is a 2 by 10 wooden member laid on its shorter edge and adjacent joists are located on 24-inch centers. The floor joists are set against the top ends of the bearing plates and extend toward the exterior of the structure beyond poles 26. The outer ends of the floor joists are aligned with each other, and these outer ends are secured to a 2 by 10 wooden band board 47 which abuts up against the outer ends. The means of securing band board to the floor joist is by nails 48, although equivalent or related construction techniques are acceptable. While the use of band board(s) 47 provides rigidity and stability to the floor joists, additional rigidity and stability are provided by metal straps 49 and 50 which are crossed for an X-bracing arrangement. Finally, a 5/8-inch plywood subfloor 51 is nailed to the top edges of the floor joists, and as should be understood, the subfloor is notched so as to clear each of the poles, and extends toward the exterior to a location which is coincident with the outer edge of the poles. Enclosed in the top edge of the band board and abutting against the exterior-most edge of the subflooring is a 2 by 6 pressure-treated wood blocking member 52. This member provides a support surface for the construction of brick veneer 27 and member 52 is nailed to the band board. The remainder of the construction aspects of wall 21 including a retaining wall which is formed by blocking member 52, band board 47, plywood pieces 60 and 61, plywood panel 56, styrofoam sheet 57 and aluminum flashing 58, are illustrated by the side elevation detail of FIG. 3 and the accompanying partial illustrations of FIGS. 4–7. After the brick veneer is mortared in place, additional dirt is placed against the retaining wall so as to create a finished grade line that overlaps at least the lowest-most row of bricks.

Vapor barrier 35 was previously described as extending toward the exterior of the structure beyond the poles. This vapor barrier extends beneath purlins 55 and then turns upwardly and extends in a vertical direction up the wall between plywood panel 56 and the poles and thereafter between the plywood panel and the exterior bearing plates 38. Perimeter insulation is provided by styrofoam sheets 57 which are placed up against the plywood panels. Thereafter, aluminum flashing 58 in thin sheet form is applied against the exterior of the styrofoam sheets, against the exterior of the band board 47, across the top surface of the wood blocking member and up the remainder of wall 21 behind the brick veneer. Disposed between the brick veneer and the aluminum flashing is a 1-inch thickness of styrofoam insulation 59. The space between the bottom edges of the band board 47 and floor joists 46 and the top edges of panel 56 and sheets 57 is filled with a ¾-inch thickness of treated plywood 60. An additional piece (or pieces) of plywood 61 is used to blend together the variation in outer surface locations between the exterior of styrofoam sheets 57 and the exterior of plywood 60 and band board 47. Fiberglass insulation illustrated at 62 is disposed between the outer ends of the floor joists between plywood 60 and blocking member 52.

As should be understood the forward (exterior) extension of the floor joists beyond the poles provides a supporting portion for the brick veneer or any other exterior surface which may be selected. Band board 47 is added as well as blocking member 52 in order to enhance the strength and stability, and the resultant assembly provides an important aspect to pole-type structures that was heretofore unavailable. This important aspect is the ability to assemble an exterior wall of substantial size and mass to the structure so that the resultant structure will be equivalent to conventional construction and construction techniques as to both the type of exterior wall which is possible as well as its appearance. Additionally, all the poles are enclosed by both the exterior walls as well as by the interior walls of the structure, thus concealing the fact that the particular structure is in fact a pole-type structure.

Figure 7:
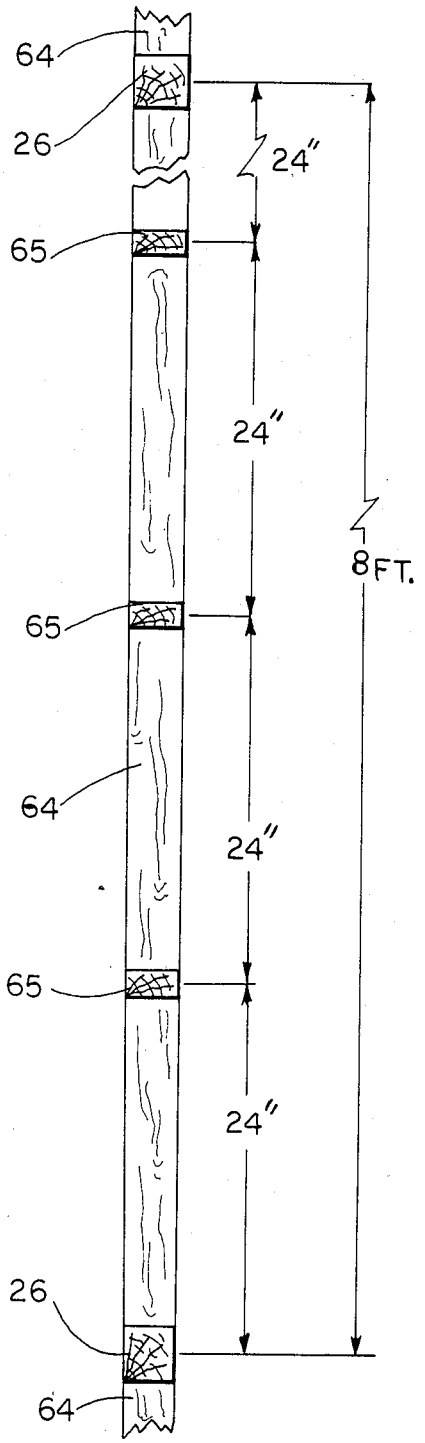
FIG. 7 is a top plan schematic view of wall studs as assembled to a sole plate between the poles of the FIG. 1 structure.

Turning to the interior of the structure, wooden members 64, which are 2×4's in the exemplary embodiment, are secured to the plywood subfloor 51. Members 64 are located in line with and between the poles and provide the sole plate for the wall studs. Referring to FIG. 7, the arrangement of the wall studs 65, which are 2×4's, relative to the poles and member 64 is illustrated in top plan view. As is noted, the poles are on on 8-foot centers, and the wall studs are place on 24-inch centers. The use of these 2-foot increments for the spacing between poles and adjacent studs provides a desired series of securing locations for the interior drywall 66 which is created from a series of 2-foot wide drywall panels.

While size references such as 4 by 4 and 2 by and 2 by 4 have been used as part of the description of the present invention, it should be understood that such descriptions are used only in their conventional sense in the construction industry. The actual dimensions of these various wooden members is less than the descriptive measurement that has been provided. For example, the 4-inch dimension of the poles is actually 3½ inches and the long sides of the 2×4's, both for member 64 and studs 65, are also 3½ inches. The result is a structure wall frame that measures 3½ inches in actual thickness, thus permitting all of the wooden members which are used in that wall frame to be disposed in line with one another and basically flush as to their exterior and interior surfaces. Consequently, substantially flat and uniform surfaces are provided on the exterior for the brick veneer and on the interior for the drywall panels. Fiberglass insulation 67 is placed between the studs prior to attaching the drywall panels. Thereafter, flooring underlay 68 is laid down and trim 69 is set in place.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A pole-type structure comprising:

earth beneath said structure, said earth having an existing earth grade;

a plurality of walls arranged together to define an interior region, at least one of said walls including a plurality of substantially vertical poles spaced apart from each other;

means for supporting each of said plurality of poles against vertical and horizontal displacement in the earth beneath said structure;

a plurality of floor joists spanning the interior regions, each joint having a support portion adjacent one end, the support portions extending exteriorly of said poles;

means for connecting said floor joists to said poles;

an exterior wall veneer disposed exteriorly of said poles and supported by the support portions of said floor joists, said exterior wall veneer having a bottom;

a retaining wall disposed exteriorly of and attached to said poles, and extending substantially from the existing earth grade to the bottom of said exterior wall veneer; and earth fill placed against said retaining wall above the existing earth grade at least to the level of the bottom of said exterior wall veneer, whereby the structure is given an exterior appearance indistinguishable from conventional frame structures built upon conventional poured concrete or block foundations.

2. The pole-type structure of claim 1, wherein each of said poles is a single piece member and each has a length sufficient to extend from its supporting location in the earth upwardly for substantially the full height of the corresponding wall.

3. The pole-type structure of claim 1, wherein said exterior wall veneer is constructed of brick mortared in place.

4. The pole-type structure of claim 1, wherein said pole supporting means includes an excavated hole into which a bearing pad is disposed.

5. The pole-type structure of claim 1, wherein said connecting means includes a plurality of bearing plate members attached to and extending substantially perpendicular to said poles, said floor joists being connected to and supported by said plurality of bearing plate members.

6. The pole-type structure of claim 5, wherein said connecting means further includes a plurality of L-brackets wherein one leg of each bracket is attached to a corresponding pole and the other leg of each bracket is attached to a corresponding bearing plate member.

7. A pole-type structure comprising:

earth beneath said structure, said earth having an existing earth grade;

a plurality of walls arranged together to define an interior region, at least one of said walls including a plurality of substantially vertical single-piece poles spaced apart from each other, each pole being supported against vertical and horizontal displacement in an excavated hole in the earth beneath said structure into which a bearing pad is disposed, each of said poles having a length sufficient to extend from its supporting location in the earth beneath said structure upwardly for substantially the full height of the corresponding wall;

a plurality of floor joists spanning the interior region, each joist having a support portion adjacent one end, the support portions extending exteriorly of said poles;

means for connecting said floor joists to said poles;

an exterior wall veneer disposed exteriorly of said poles and supported by the support portions of said floor joists, said exterior wall veneer having a bottom;

a retaining wall disposed exteriorly of and attached to said poles and extending substantially from the existing earth grade to the bottom of said exterior wall veneer; and earth fill placed against said retaining wall above the existing earth grade at least to the level of the bottom of said exterior wall veneer.

8. The pole-type structure of claim 7, wherein said exterior wall veneer is constructed of brick mortared in place.

9. The pole-type structure of claim 7, wherein said connecting means includes a plurality of bearing plate members attached to and extending substantially perpendicular to said poles, said floor joists being connected to and supported by said plurality of bearing plate members.

10. A method of constructing a pole-type structure on earth having a existing earth grade which comprises the following steps:

excavating a plurality of spaced-apart holes;

pouring a concrete bearing pad in each of said holes;

placing a single-piece pole substantially vertically onto each of said concrete bearing pads;

attaching bearing plates to said poles;

assembling a plurality of floor joists across said bearing plates such that the end portions of each of said floor joists extends exteriorly of said poles;

covering said end portions with a blocking member;

mortaring bricks atop said blocking member to create an exterior wall veneer exterior of said poles and having a bottom;

attaching a retaining wall to said poles exteriorly of said poles, which retaining wall extends substantially from the existing earth grade to the bottom of said exterior wall veneer; and placing earth fill against said retaining wall above the existing earth grade at least to the level of the bottom of said exterior wall veneer, whereby the structure is given an exterior appearance indistinguishable from conventional frame structures built upon conventional poured concrete or block foundations.

* * * * *

UNITED STATES PATENT AND TRADEMARK OFFICE

CERTIFICATE OF CORRECTION

PATENT NO. : 4,563,842

DATED : Jan. 14, 1986

INVENTOR(S) : Bradley D. Lewis

It is certified that error appears in the above-identified patent and that said Letters Patent are hereby corrected as shown below:

Column 7, line 26 should read as follows:

"While size references such as 4 by 4 and 2 by 10 and 2 . . ."

Signed and Sealed this

*Thirteenth* Day of *May 1986*

[SEAL]

*Attest:*

DONALD J. QUIGG

*Attesting Officer*

*Commissioner of Patents and Trademarks*